US008662324B2

(12) United States Patent
Robinson

(10) Patent No.: US 8,662,324 B2
(45) Date of Patent: Mar. 4, 2014

(54) MATERIAL ORGANIZER

(76) Inventor: Darrell Robinson, Detroit, MI (US)

( * ) Notice: Subject to any disclaimer, the term of this patent is extended or adjusted under 35 U.S.C. 154(b) by 70 days.

(21) Appl. No.: 13/305,082

(22) Filed: Nov. 28, 2011

(65) Prior Publication Data

US 2012/0132763 A1 May 31, 2012

Related U.S. Application Data

(60) Provisional application No. 61/417,625, filed on Nov. 29, 2010.

(51) Int. Cl.
*A47F 5/06* (2006.01)

(52) U.S. Cl.
USPC ..... 211/126.4; 211/126.5; 211/133.3; 211/133.4; 211/205; 248/558; 248/105; 248/125.3; 248/912

(58) Field of Classification Search
USPC ..... 248/558, 27.8, 102, 105, 121, 125.3, 248/170, 911, 912; 5/655; 211/119.006, 211/126.4, 126.5, 133.1, 133.3, 133.4, 193, 211/205
See application file for complete search history.

(56) References Cited

U.S. PATENT DOCUMENTS 469,216 A * 2/1892 Quinn ..... 211/77
575,711 A * 1/1897 Haley ..... 108/50.13
749,494 A * 1/1904 Mason ..... 211/65
1,599,616 A * 9/1926 Hamburger ..... 248/125.3
2,136,109 A * 11/1938 Kress ..... 248/221.11
2,593,567 A * 4/1952 Keck ..... 211/119.006
2,890,801 A * 6/1959 Ladd et al. ..... 211/59.1
3,281,102 A * 10/1966 Hobson ..... 248/125.3
3,310,180 A * 3/1967 Neagle ..... 211/205
3,771,665 A * 11/1973 Potter ..... 211/107
4,040,588 A * 8/1977 Papsco et al. ..... 248/245
4,865,283 A * 9/1989 Parker ..... 248/159
5,092,546 A * 3/1992 Wolfbauer ..... 248/49
5,170,898 A * 12/1992 Katz et al. ..... 211/193
5,372,265 A * 12/1994 Monch ..... 211/187
5,386,961 A * 2/1995 Lu ..... 248/223.41
5,906,284 A * 5/1999 Hammerstrom et al. ..... 211/205
6,964,595 B2 * 11/2005 Libretti ..... 446/482
7,802,764 B2 * 9/2010 Leinen ..... 248/129
7,918,422 B2 * 4/2011 Blankenship et al. ..... 248/129
8,113,475 B2 * 2/2012 Whittemore et al. ..... 248/229.16
8,152,115 B2 * 4/2012 Blichmann ..... 248/159
8,398,049 B2 * 3/2013 Lategan ..... 248/558
2002/0179783 A1 * 12/2002 Kim ..... 248/122.1
2007/0200035 A1 * 8/2007 Chamberlain et al. ..... 248/121
2008/0116327 A1 * 5/2008 Goldberg ..... 248/121
2012/0193487 A1 * 8/2012 Tsao ..... 248/125.1

* cited by examiner

*Primary Examiner* — Bradley Duckworth
(74) *Attorney, Agent, or Firm* — Gifford, Krass, Sprinkle, Anderson & Citkowski, P.C.

(57) ABSTRACT

An infant care organizational aid including a vertically extending and multi-sided body with a plurality of extending legs engaging a floor location. A plurality of clips extend from surface locations of the body and are configured to receive end extending portions associated with each of a plurality of individual holders in order to engage with specified clip locations associated with the body. Each of the holders are configured for supporting an infant related item or accessory including such as any of a formula holder, cup holder, bottle holder, toy box, diaper/clothes basket, spoon/utensil holder, cereal box holder and tray.

6 Claims, 3 Drawing Sheets

MATERIAL ORGANIZER

CROSS-REFERENCE TO RELATED APPLICATIONS

This Application claims the benefit of U.S. Provisional Application 61/417,625 filed on Nov. 29, 2010.

FIELD OF THE INVENTION

The present invention relates generally to a mobile infant care organizer. More specifically, the present invention teaches a roller supported and repositionable tower to which is removably engaged a plurality of attachments for individually supporting any of a plurality of infant related items not limited to bottle/cup holders, food and utensil holders, toys, clothes, diapers and the like.

BACKGROUND OF THE INVENTION

The ability to maintain infant care accessories in easily accessible and orderly fashion is a challenge in the process or providing effective child care for parents, day care providers and the like. Given the mobile nature of infants/toddlers, a continuous challenge to such care givers is the ability to maintain, in one location, such disparate items as bottles, diapers, wipes, rash ointments, the ability of which avoids having to either carry the infant/child from one location to another and/or to leave the infant/child unattended in order to retrieve a necessary item during feeding, changing, etc.

SUMMARY OF THE INVENTION

The present invention discloses an infant care organizational aid which allows for maintaining varied infant and child care accessories in one organized location which is additionally easily transportable/maneuverable. The organizational aid includes a vertically extending and multi-sided body with a plurality of extending legs engaging a floor location. A plurality of clips extend from surface locations of the body and are configured to receive end extending portions associated with each of a plurality of individual holders in order to engage with specified clip locations associated with the body.

Each of the holders are configured for supporting an infant related item or accessory including such as any of a formula holder, cup holder, bottle holder, toy box, diaper/clothes basket, spoon/utensil holder, cereal box holder and tray. Additional features include constructing the multi-sided body from a plasticized material and providing swivelable castors or rollers at bottom extending location of the extending legs in order to facilitate ease of movement of the organizational aid.

BRIEF DESCRIPTION OF THE DRAWINGS

Referenced will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention teaches a roller supported and repositionable infant/child care organization aid, such as in the shape of a tower to which is removably engaged a plurality of attachments for individually supporting any of a plurality of infant related items not limited to bottle/cup holders, food and utensil holders, toys, clothes, diapers and the like. As will be described in further detail, the organizational aid makes it easier to keep infant-care accessories together for ease of access and use and so as to avoid the necessity of carrying the child from one location to another in search of needed items, or of leaving the child unattended during such pursuits.

Figure 1:
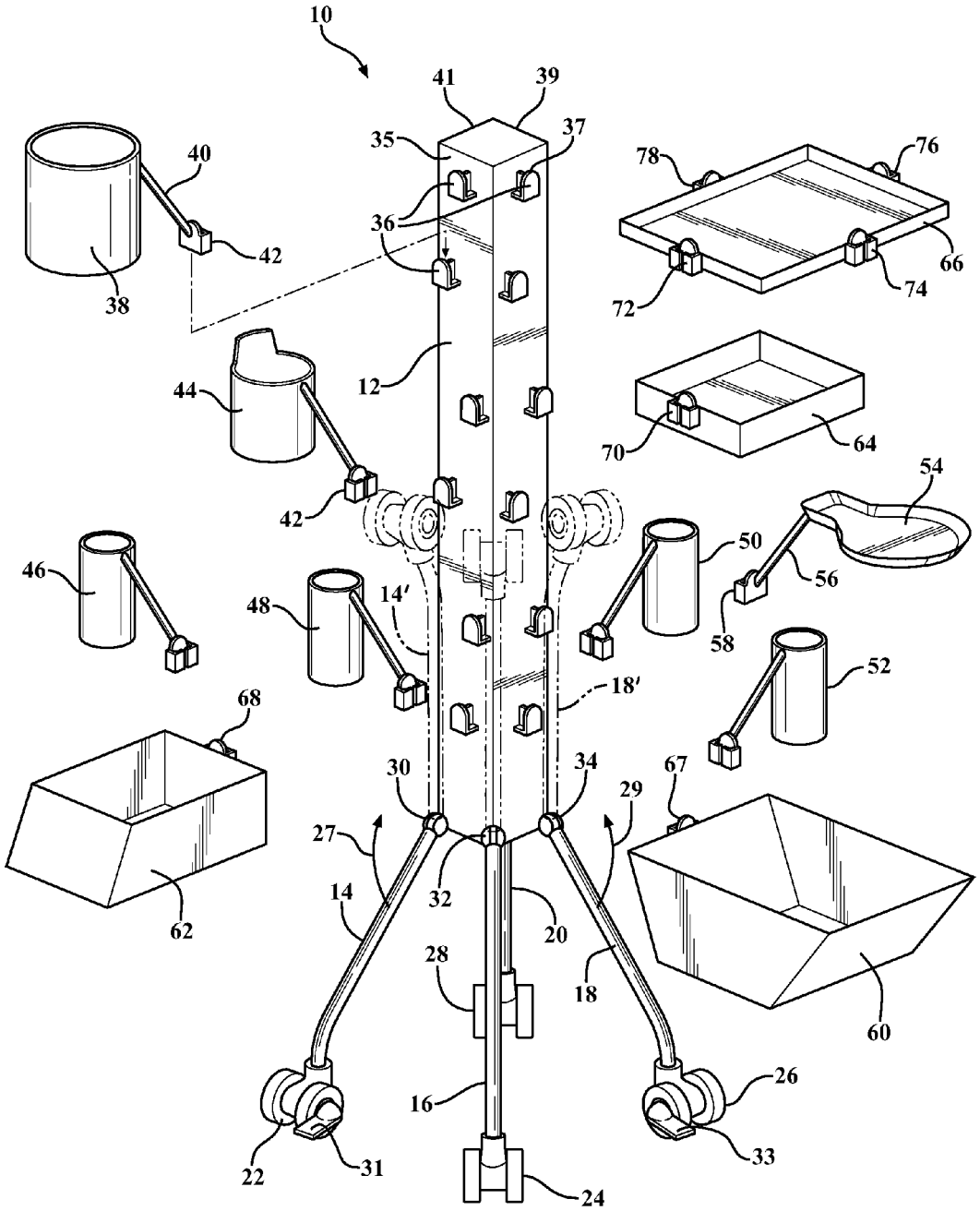
FIG. 1 is an exploded view of the tower shaped and movable organizer according to a non-limiting embodiment of the present invention.

Referring first to FIG. 1, an exploded view is generally shown at 10 of the tower shaped and movable organizer according to a non-limiting embodiment of the present invention. Specifically, a vertical extending, elongated, and multi-sided main body is generally depicted at 12 and which is supported upon a plurality of legs shown at 14, 16, 18 and 20. Each of the legs and body can be constructed of any suitable material, including a durable plastic or lightweight metal such as aluminum. Each of the legs further exhibits a bottom located and swivelable roller (i.e. also interpreted to include castor style) support, see further at 22, 24, 26 and 28.

Figure 2:
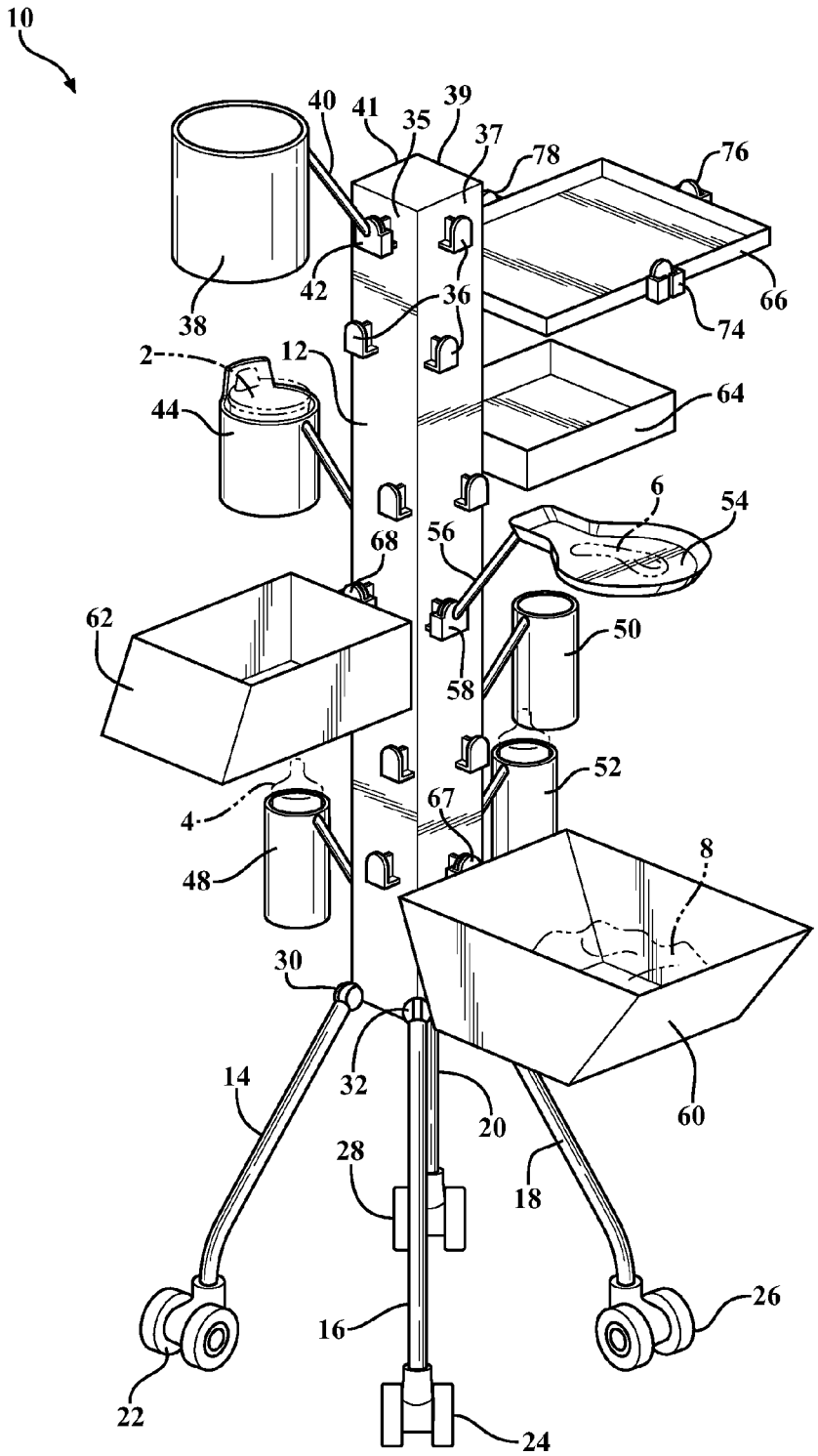
FIG. 2 is a similar view better illustrating the attachment protocol for mounting the various individual trays and item supporting devices to selected locations along the plurality of vertical extending faces associated with the tower.

As further indicated at 30, 32 and 34 for selected legs 14, 16 and 18 best viewed in FIG. 1 (with an upper pivotal connection for further leg 20 being hidden from view), pivot connections are established between the legs and bottom end locations of the elongated body 12. The pivot connections 30, 32, 34 et seq. can include one or more frictionally rotating and engaging portions established between extending and spaced apart upper portions of each leg (as shown in FIGS. 1-2) and the lower projecting locations of the body 12, such as which define frictionally inter-rotating (e.g. seating and/or biasing) surfaces for facilitating folding of the legs.

Additional variants contemplate the incorporation of any suitable linkage or locking mechanism for easily converting each of the pivotal legs between downwardly engaged and upwardly folded storage configurations. It is also contemplated that any other arrangement of pins or other biasing seating portions may be incorporated for affixing the legs to the bottom of the tower shaped body 12 to permit the legs 14, 16, 18 and 20 to be folded upwardly. This is further illustrated by see arrows 27 and 29 in FIG. 1 referencing selected legs 14 and 18 and which are converted from the downwardly engaged positions depicted in solid to the upwardly folded and storage positions in phantom and by which they upwardly abut against the vertically extending and tower shaped body 12 so as to maintain the device stationary or during storage or other periods of non-use.

Other variants contemplate the legs being anchored or fixed relative to the bottom of the tower body 12 and it is further envisioned and understood that a reduced plurality of such as three legs can be provided in a generally tripod style support within the scope of the invention. Any number (or all) of the wheeled castors or roller supports can further include any form of locking structure, such as is represented at 31 and 33 in FIG. 1 by pivotal locking levers for respective wheels 22 and 26, and in order to prevent transport of the assembly when desired.

The vertically elongate (tower shape) body can again include any cross sectional configuration or profile, such as exhibiting any number of interconnected and polygonal defining sides. In the illustrated embodiment, a plurality of four sides 35, 37, 39, and 41 are depicted, with it further being understood that additional variants can range from a reduced number of three sides (defining an overall triangular shaped cross sectional profile) to an infinite number of sides which establishes a generally rounded shape.

Configured at spaced locations along each of the vertically extending sides of the main body 12 are supporting clips or attachments, see as shown at 36. As further shown, the clips 36 are configured successive forwardly spaced and upwardly extending fashion from inter-spaced apart surface locations along each of the individual and interconnected sides 35, 37, 39 and 41 of the body, in any pattern or arrangement desired, and such as with of the clips 36 being integrally formed with the body and each exhibiting a substantially "L" shape in vertical extending fashion with a forwardly projecting lower edge and an upwardly and outwardly spaced extending leg.

Additional to the arrangement of clips depicted, additional envisioned variants may also contemplate reconfiguring the clips as apertures, slots or any other suitable engagement locations associated with the surfaces of the body. These alternate arrangements may further contemplate configuring each of the extending sides of the body with vertical or horizontal rail or channel supports which may in turn be reconfigured to provide alternate mounting structure to the clips 36 described above.

Each of a plurality of individual and infant accessory supporting holders are provided (such as again constructed of a plastic or lightweight metal) and which, as per the illustrated embodiment, engage with a given body supported clip 36 so as to be supported in a spatially displaced and accessible fashion at given sides and elevations associated with the body. Without limitation, these may include each of a cylindrical body closed at the bottom with an upper open end provided such as a formula holder 38, and from which extends a suspending leg 40 terminating in a particularly configured clip engaging end component, illustrated at 42.

Each of the holder projecting clips as shown includes any form partially or fully closed tabs or brackets which define a vertically accessible slot therebetween and which (as best depicted in succeeding FIG. 2) receive the vertical upwardly extending portion of a selected clip 36, in order to be adjustably affixed in supporting fashion to the body 12. Consistent with the previous description, the clip engaging end components can further be redesigned into any alternate shape for engaging any type of aperture, slot or the like previously formed or configured into the tower body.

Additional bottle and cup holders are depicted at 44, 46, 48, 50 and 52, each of which being constructed similar to the formula holder 38 and such that each includes a cylindrical or similar volume holding interior from which extends an extending leg and clip engaging end component. Additional configurations of holders include and are not limited to a spoon holder 54 exhibiting a generally planar, shallow surface and likewise again including a downwardly/angled leg 56 with end supported clip engaging end component 58 of similar construction to that previously described at 42.

Also depicted are a further array of rectangular/trapezoidal shaped, depth defining and planar supporting item holders, each exhibiting varying depths and configurations and including such as a clothes/diaper basket 60, a toy box 62, a cereal box holder 64 and a further four sided (enlarged) tray 66. Each of the basket 60, toy box 62 and cereal box holder 64 exhibits a single clip engaging component (at 67, 68, and 70, respectively) extending from a side location of each item, with the enlarged four sided tray 66 further including a plurality of matching clip engagement components 72, 74, 76 and 78 arranged on individual sides thereof for permitting the tray to be attached to the tower 12 along any of its sides at the desire of the user and in order to adjust the extending dimensions of the tray 66.

In use, the legs are rotated downwardly into position and the collection of infant accessory holders are attached to selected clips according to any desired arrangement. The wheels allow transport of the organizer upon any surface, such as carpet and, when desired, the locking portions (such as representatively again depicted at 31 and 33) can be engaged in order to maintain position of the assembly when supported upon any generally smooth surface, including such as linoleum, ceramic or hardwood floor surface.

In one non-limiting variant, the tower shaped organizer can exhibit a height of 3-4 feet and is again constructed of a (optionally sanitary) plasticized material, this further contemplating bright colors and a plasticized matrix which incorporates or is chemically impregnated with an antimicrobial composition. It is further envisioned and understood that the body 12 can be constructed of other materials exhibiting the necessary properties of strength and durability, and further that it can likewise be reshaped in any manner desired (and not limited to a single vertically extending tower) in order to support and position in arrayed fashion any arrangement of infant care items. This can further include reconfiguring the tower to include any form of arcuate or artistic shaping which retains the necessary pedestal supporting aspects.

Likewise, the various cup, utensil and tray holders for supporting the infant care accessories can be reconfigured or refashioned in any manner desired for engaging to the elevated device. This can further include modifying the shape and capacity of each accessory support, such as by non-limiting example providing dual cup or bottle holders, changing the dimensions of the basket or tray attachments, and further providing some degree of motion adjustment or articulation of the arms and end supported clips in order to facilitate ease of use.

As previously described, FIG. 2 is a similar view better illustrating the attachment protocol for mounting the various individual trays and item supporting devices previously described, and via their extending end engagement components (e.g. at 42) to selected clip configured surface locations (e.g. further at 36) associated with each of the interconnecting plurality of vertical extending faces associated with the tower 12. In this manner, the tower assembly and various item holding components can be rearranged in any of an unlimited number of configurations as desired by the user and in order to position and support typical infant care accessories as generally shown in phantom at 2 (sippy cup), 4 (bottle), 6 (spoon) and 8 (diaper or linen article). As previously described, the various affixable item holders can be provided and/or reconfigured, as needed to hold additional accessories such as toys, toy boxes, cereal box, clothes, etc.

Figure 3:
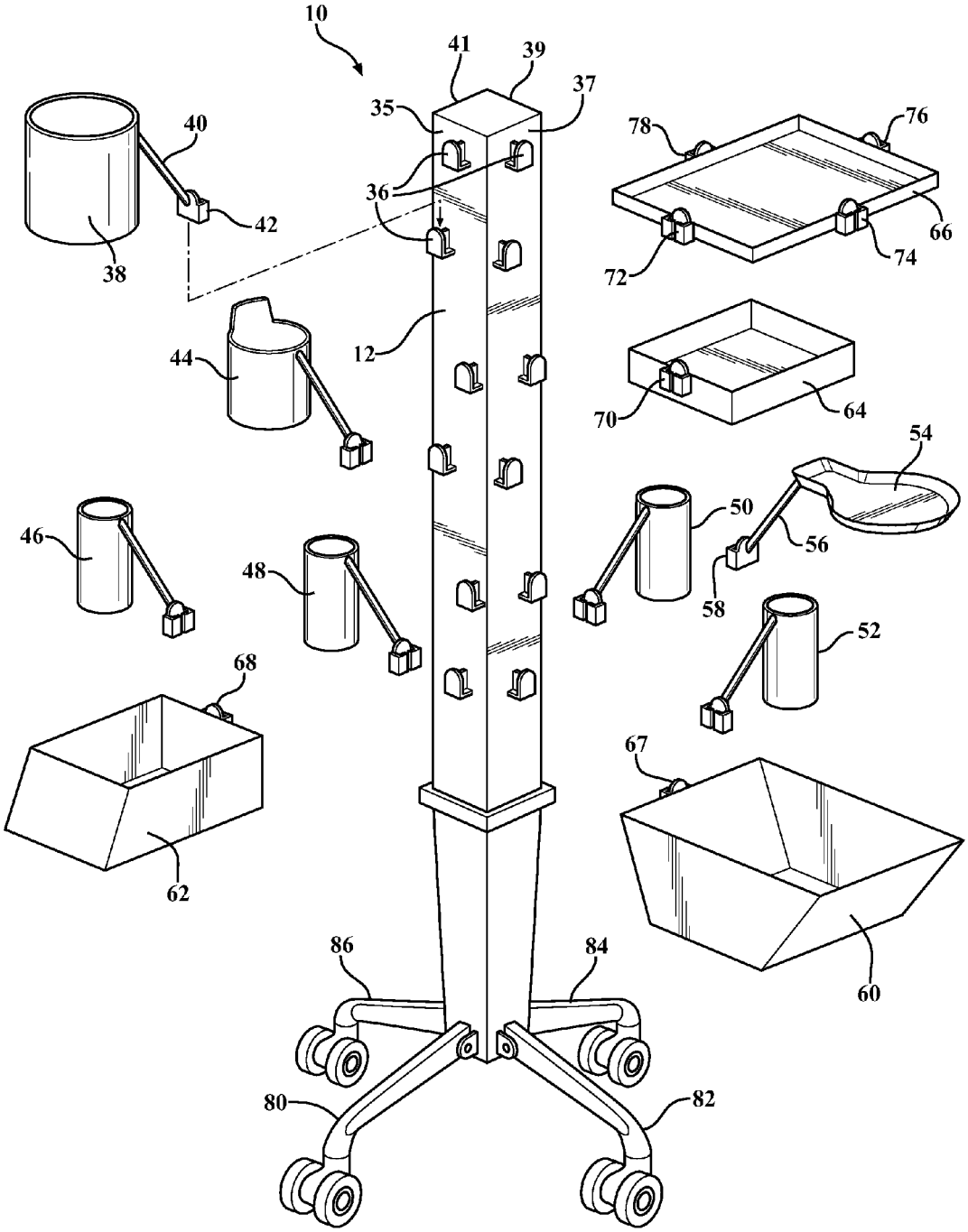
FIG. 3 is a yet further perspective view in partial exploded fashion and illustrating a similar variant of organizer with alternatively configured roller supported legs.

FIG. 3 is a further perspective view in partial exploded fashion and illustrating a similar variant of organizer with alternatively configured roller supported legs. In order to avoid a repetitive description as to those features previously referenced in FIG. 1, duplicate reference numerals are not included, except as to point out, in reference to FIG. 3, that the alternate arrangement of roller supporting legs, at 80, 82, 84 and 86, is provided. The legs 80-86 can optionally be provided as fixed or non-rotating elements, however locking portions or the like can again be designed into the roller portions as previously described.

The organizational device provides the advantages of maintaining, at one easily accessible location, all typical baby care items and which avoids the necessity of the parent or infant care giver from having to leave the infant unattended while looking for a desired item.

Having described my invention, other and additional preferred embodiments will become apparent to those skilled in the art to which it pertains, and without deviating from the scope of the appended claims.

I claim:

1. An infant care organizational aid, comprising:

an upwardly extending body exhibiting a plurality of interconnecting and planar surfaces;

a plurality of clips integrally formed with said interconnected surfaces, said clips each exhibiting an "L" shape in side profile with an outwardly projecting lower portion and a solid upwardly projecting and outwardly spaced extending portion;

a plurality of legs extending from said body and engaging a floor location;

a plurality of individual holders engageable with said body, each of said holders having an elongated leg extending from an engaging end component, said leg terminating in a holder component for supporting an infant related item or accessory, each of said holder components further having a volume defining construction which is anchored to a distal extending end of said elongate extending leg; and each of said engaging end components further having an aperture receiving in engaging fashion therethrough an upwardly projecting portion of a selected clip and in order to mount said holder in an outwardly extending fashion from said body.

2. The organizational aid as described in claim 1, said holders further comprising at least one of a formula holder, cup holder, bottle holder, toy box, diaper/clothes basket, spoon/utensil holder, cereal box holder and tray.

3. The organizational aid as described in claim 1, said body further comprising a plasticized material.

4. The organizational aid as described in claim 1, said end engaging components of each of said individual holders each further comprising at least one of a partially or fully closed tab or bracket which defines a vertically accessible slot therebetween for receive said upwardly extending leg of a selected clip in order to be adjustably affixed in supporting fashion to said body.

5. The organizational aid as described in claim 1, further comprising said legs terminating in wheeled supports.

6. The organizational aid as described in claim 5, further comprising said legs being pivotally mounted to said body and in order to be converted from downwardly rotated use and upwardly rotated storage positions.

* * * * *